US007669945B2

(12) United States Patent
Blersch et al.

(10) Patent No.: US 7,669,945 B2
(45) Date of Patent: Mar. 2, 2010

(54) REFRIGERATING OR FREEZING APPARATUS

(75) Inventors: Dietmar Blersch, Ertingen (DE); Josef Hecht, Erlenmoos (DE)

(73) Assignee: Liebherr-Hausegeraete Ochsenhausen GmbH, Ochsenhausen (DE)

( * ) Notice: Subject to any disclaimer, the term of this patent is extended or adjusted under 35 U.S.C. 154(b) by 0 days.

(21) Appl. No.: 11/268,099

(22) Filed: Nov. 7, 2005

(65) Prior Publication Data

US 2006/0163985 A1 Jul. 27, 2006

(30) Foreign Application Priority Data

Nov. 5, 2004 (DE) ..... 20 2004 017 125 U

(51) Int. Cl.
*A47B 96/02* (2006.01)

(52) U.S. Cl. ..... 312/408; 108/107

(58) Field of Classification Search ..... 312/408, 312/406, 351, 321.5; 108/147.16, 147.11, 108/106, 107, 108, 109, 110, 146; 248/243, 248/224.61, 244, 245, 246
See application file for complete search history.

(56) References Cited

U.S. PATENT DOCUMENTS

| | | | | | |
|---|---|---|---|---|---|
| 388,066 | A * | 8/1888 | Murphy | 108/110 |
| 716,852 | A * | 12/1902 | Beckett | 248/244 |
| 754,816 | A * | 3/1904 | Schriefer | 108/109 |
| 2,005,057 | A | 6/1935 | Summers | |
| 2,146,950 | A * | 2/1939 | Foster | 312/408 |
| 2,149,603 | A * | 3/1939 | Hamby | 108/157.13 |
| RE21,871 | E * | 8/1941 | Welch | 248/243 |
| 2,291,176 | A * | 7/1942 | Vanderveld | 211/190 |
| 2,355,651 | A * | 8/1944 | Hormes | 248/243 |
| 2,549,879 | A * | 4/1951 | Amore | 312/406.2 |
| 2,604,375 | A * | 7/1952 | Beckett | 312/351 |
| 2,620,255 | A * | 12/1952 | Beckett | 312/351 |
| 2,644,591 | A | 7/1953 | McMahan | |
| 2,677,519 | A * | 5/1954 | Hobson | 248/125.3 |
| 2,872,144 | A | 2/1959 | Hobson | |
| 3,162,416 | A | 12/1964 | Amarillas | |
| 3,219,405 | A | 11/1965 | Constantini et al. | |
| 3,429,540 | A * | 2/1969 | Worrallo | 248/246 |
| 3,613,900 | A * | 10/1971 | Chiu | 108/106 |
| 3,707,226 | A | 12/1972 | Wippermann | |
| 4,174,486 | A * | 11/1979 | Winkler | 312/321.5 |
| 4,212,445 | A * | 7/1980 | Hagen | 248/245 |
| 4,299,368 | A * | 11/1981 | Winkler | 248/246 |
| 4,421,289 | A * | 12/1983 | Sturm | 248/246 |
| 4,568,050 | A * | 2/1986 | Radoy et al. | 248/223.41 |
| 4,779,939 | A * | 10/1988 | Stich | 312/405 |
| 4,938,444 | A * | 7/1990 | Worrallo | 248/297.21 |
| 5,893,620 | A * | 4/1999 | Birgelis | 312/408 |
| 6,935,712 | B2 * | 8/2005 | Reed et al. | 312/405 |

FOREIGN PATENT DOCUMENTS

| | | |
|---|---|---|
| CA | 2350930 | * 6/2002 |
| DE | 1713539 | 11/1955 |

(Continued)

*Primary Examiner*—Janet M Wilkens
(74) *Attorney, Agent, or Firm*—Dilworth & Barrese, LLP

(57) ABSTRACT

A refrigerator or freezer is provided with a chilling space for receiving refrigerated or frozen products and a holder for a support tray for the products, the holder at most projecting only insignificantly beyond the wall of the chilling space.

26 Claims, 13 Drawing Sheets

FOREIGN PATENT DOCUMENTS

| | | |
|---|---|---|
| DE | 936984 | 12/1955 |
| DE | 454385 | 4/1968 |
| DE | 9114505 | 3/1993 |
| DE | 9314675 | 9/1994 |
| DE | 19527731 | 1/1997 |
| DE | 29710715 | 12/1997 |
| DE | 19907186 | 8/2000 |
| DE | 20213439 | 3/2003 |
| EP | 619464 | * 10/1994 |
| EP | 0653598 | 5/1995 |
| EP | 1 443 292 | 4/2004 |
| FR | 2751058 | 1/1998 |
| JP | 03213982 | 9/1991 |
| JP | 04121570 | 4/1992 |
| JP | 2003-269857 | 9/2003 |

* cited by examiner

Fig. 1
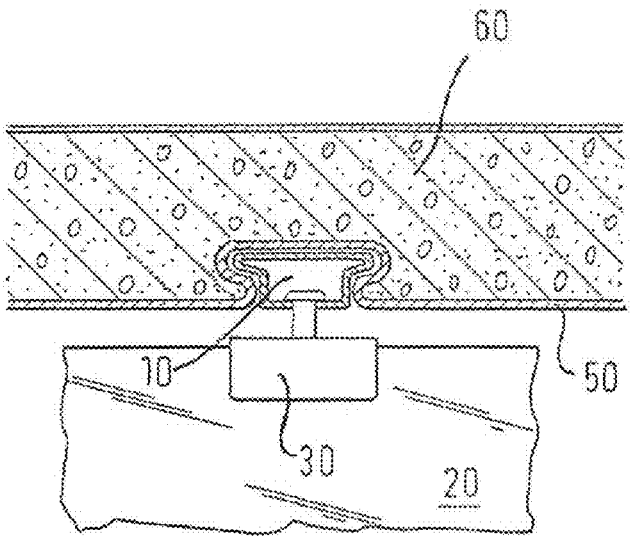
Fig. 1B
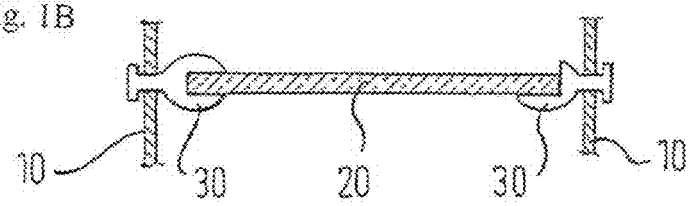
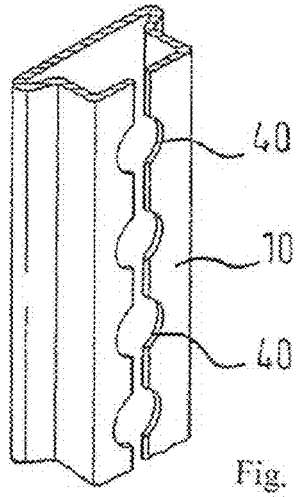
Fig. 1C
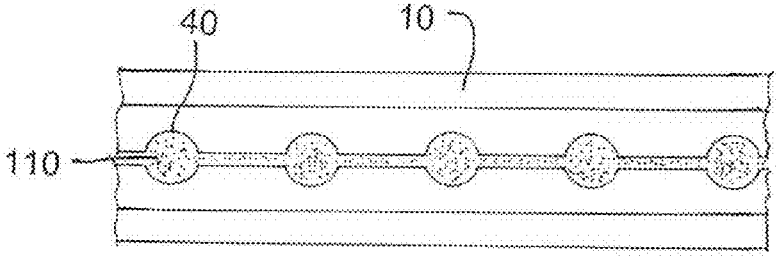
Fig. 1A

Fig. 4A
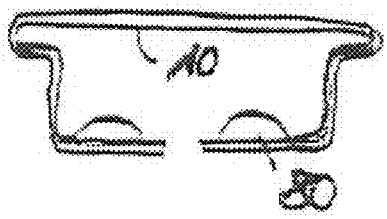
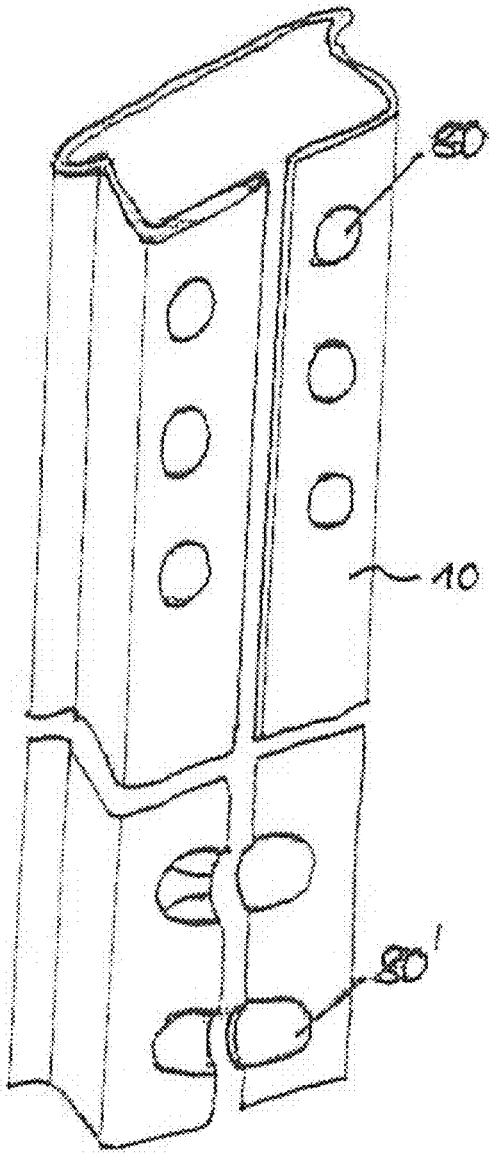
Fig. 4B

Fig. 5A
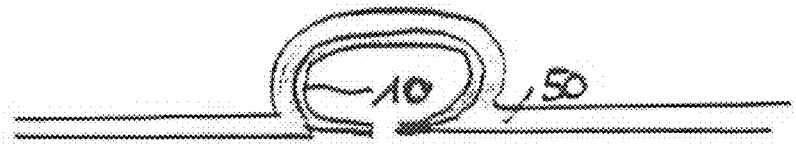
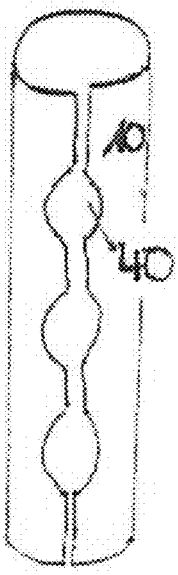
Fig. 5B

REFRIGERATING OR FREEZING APPARATUS

BACKGROUND OF THE INVENTION

The present invention relates to a refrigerating or freezing apparatus, in particular to a refrigerator or a freezer, comprising a chilling space for the reception of the refrigerated or frozen product which can be closed by a door or lid.

It is customary in currently known refrigerating or freezing apparatus to provide support trays for the reception of the refrigerated or frozen product which lie on shaped ribs which extend from the oppositely disposed side walls of the chilling space. As a rule, a plurality of ribs are provided spaced apart in the vertical direction so that the support trays can be arranged at different heights in the chilling space.

Previously known solutions have the disadvantage, on the one hand, that due to the said ribs troublesome edges are located in the chilling space which are difficult to clean, impair the visual impression and reduce the storage space. A further disadvantage of previously known refrigerating apparatus consists of the fact that, due to the limited number of the ribs, the adjustment possibilities for the support trays are likewise limited accordingly in the vertical direction.

SUMMARY OF THE INVENTION

It is the object of the invention to further develop a refrigerating or freezing apparatus of the initially named kind such that the fixing of support trays in the chilling space is possible without the said disadvantages.

This object is solved by a refrigerating apparatus having the features described herein. Provision is accordingly made for one or more means of holding a support tray to be provided in at least one of the walls of the chilling space, said means not projecting, or projecting only slightly, beyond the wall of the chilling space. In this manner, a smooth or largely smooth inner wall of the chilling space or of the interior container of the refrigerating apparatus results. Troublesome edges such as in previously known apparatus are not present. The means of holding a support tray can be cut-outs such as slots, holes and the like or also support regions such as contact surfaces onto which the support trays or holding elements of the support trays are inserted or placed. The type and design of the means of holding a support tray can generally be any desired one, provided that it is ensured that they do not project, or only project insignificantly, so that a smooth or largely smooth inner wall of the chilling space results.

The solution in accordance with the invention provides the possibility in a preferred aspect of the invention that the support trays, which are, for example, made as glass plates, can be removed and adjusted with respect to their height at a door opening of 90°, without cut-aways/recesses being required at the support surfaces. Due to the design of the means of holding a support tray in accordance with the invention, the support trays can reach up to the walls of the chilling space in a flush manner and thus also be used for small parts.

In a preferred aspect of the invention, the means of holding a support tray are cut-outs or support regions or contact surfaces. A design is particularly preferred in which the cut-outs/support regions are spaced apart from one another in the vertical direction of the chilling space. If the spacing of the cut-outs or support regions is low, a plurality of feasible adjustment possibilities results for the support trays, whereby a correspondingly high variability can be achieved.

The means of holding a support tray can be a cut-out, preferably a groove or a gap, which is at least sectionally throughgoing. Corresponding holding elements, on which the support trays lie, can be inserted or wedged in these. In this case, an unlimited number of adjustment possibilities in the direction of the groove or of the gap result.

It is particularly advantageous for at least one rail having the means to hold a support tray to be arranged in at least one of the walls of the chilling space and to be integrated into the wall of the chilling space such that it does not project, or does not substantially project, over it and preferably terminates with it in a flush manner. In this embodiment of the invention, rails are integrated preferably perpendicular or obliquely and in a flush manner into the side wall or into a groove provided there, whereby a smoother interior container or smooth walls of the chilling space result.

As stated above, it is of particular advantage for the rail to have cut-outs or support regions for the support trays spaced apart from one another.

The cut-outs spaced apart from one another can generally have any desired design. They can be circular, oval, angular or slit-shaped. Other designs are also feasible. It is also possible for the means of holding the support trays to have support regions. The latter can be made as tabs. It is, for example, conceivable for rails to be let into the walls of the refrigerating apparatus from which tabs extend which serve the reception of support trays or of holders for support trays.

The cross-sectional profile of the rail can essentially be as desired. For example, U-shaped, box-shaped, circular, oval profiles or also profiles which are dovetailed in cross-section can be considered. It is also conceivable for the rail not to consist of these profiles, but to have correspondingly profiled sections. It is, for example, possible for the profile to have to limbs which are arranged in a dovetailed manner with respect to one another. A parallel arrangement of the limbs is also conceivable.

In a further aspect of the invention, provision can accordingly be made for the rail to have two limbs which bound a region accessible from the chilling space and on whose sides facing one another cut-outs or support surfaces are arranged. The latter can be formed as tabs projecting from the limbs or by stampings located in the limbs.

In a further aspect of the invention, provision is made that the rail has an undercut which is integrated in the wall of the chilling space.

The rail can be made in one piece or of a plurality of segments preferably spaced apart from one another in the vertical direction of the chilling space.

It is particularly preferred for the rail to be received vertically or in a slantingly extending manner in the wall of the chilling space. In a preferred aspect of the invention, a plurality of rails are provided which are spaced apart from one another in the peripheral direction of the chilling space. It is, for example, conceivable that two rails are provided at each of the two oppositely disposed side walls of the chilling space. Embodiments are also conceivable in which one or more rails are provided at the rear wall of the chilling space. These embodiments generally apply no just to rails, but to every type of means of holding the support trays.

To reduce the proneness to contamination, provision can be made for the means of holding a support tray to be made as cut-outs and for cut-outs not required for support trays to be closed by plugs.

In a further aspect of the invention, provision can be made for the means of holding a support tray to be made as cut-outs and for a yielding or resilient material to be located in the region behind the cut-outs. This material is preferably arranged such that it closes the cut-outs at the side remote from the chilling space and yields accordingly on the insertion or introduction of holding elements of the support trays. It is, for example, conceivable to place an elastomer strip on the rear side of a rail. The design of the rail can largely be as desired in this process. This aspect of the invention makes it possible to close the cut-outs of the rail which are not required by the said yielding material and to provide a particularly appealing visual impression of the chilling space in this manner. This aspect of the invention can be used in any desired types and arrangements of cut-outs and is not limited to the cut-outs being provided in rails.

The yielding material is fastened in a suitable manner to a side of the rail remote from the chilling space. In this process, the fixing of the yielding material preferably takes place such that the material closes the cut-outs of the rail and ends with the front side of the rail facing the chilling space in the region of the cut-outs such that a smooth surface results in the region of cut-outs of the rail which are not needed.

In a further aspect of the invention, provision is made for the means of holding a support tray to be made as cut-outs and for a cover to be located in the region behind the cut-outs which can be moved into different positions. In a first position, the cover closes the cut-outs such that the cut-outs are visible from the view of the chilling space and the cover closing them is visible directly behind them. In a second position, there is a spacing between the cover and the cut-outs which is necessary to receive holding elements which serve for the fixing of a support tray. In this case, the cover is urged back by the holding element and thus exposes a space between the cut-out and the cover in which a section of a holding element is located. The said cut-outs are preferably located in the aforesaid rail.

In this process, provision is preferably made for the cover to be resilient such that it springs back after the removal of the holding element and again closes the cut-out.

The cover can per se by any desired material. Plastics or metals can e.g. be considered, preferably spring plate metal. The cover can be made in strip shape, for example. Other designs are generally also conceivable.

To effect or promote the moving back of the cover toward the cut-out when the holding element is removed again, provision is made in a further aspect of the invention for means to be provided which exert a force acting in the direction of the cut-out on the cover. Any desired means can be considered which are located behind the cover from the view of the chilling space such as one or more springs or also a resilient material, such as an elastomer strip, which presses the covers onto the cut-outs.

In a further aspect of the invention, holding elements are provided which serve to support the support trays and which cooperate, in the inserted state of the support trays, with the support trays and with the means of holding the support trays. The holding elements can have a first section which is inserted into or placed onto the means of holding a support tray made as cut-outs or as supports and a second section onto which the support tray can be placed. It is conceivable for the holding elements to be made as loose suspension parts which serve the support of the support trays.

It is likewise possible for the holding elements to have an adjustment mechanism by means of which the holding elements are adjustable between a first position in which the holding elements are in engagement with the means of holding a support tray and a second position in which the holding elements are not in engagement with the means of holding a support tray. A mechanism of this type has the advantage that the latch positions can be locked and unlocked, preferably with one movement. It is a particular advantage of an embodiment of this type that the positions of the support trays can be changed comfortably without them having to be removed from the chilling space and without the refrigerated product located thereon having to be removed.

In a further aspect of the invention, provision is made for the holding elements to be arranged at the support tray.

The holding elements can be made as resiliently arranged projections which, in a first position, engage into the means of holding the support trays and, in a second position, are arranged so remote from these that the projections no longer cooperate with the means of holding a support tray. It is, for example, conceivable for one or more projections to be arranged at an edge region of a support tray which are connected to the support tray by means of a resilient section, for example, via a spring metal plate. If the spring metal plate is bent back with respect to the container wall of the apparatus in the inserted state of the support tray, the support tray can be removed. In the non-actuated state of the spring metal plate, the projection arranged in the end region of the spring metal plate engages into the means of holding a support tray, whereby the support tray is correspondingly supported. It is possible for an arrangement of this type to be provided at one side or also at more than one side of the support tray. It is generally sufficient to provide an arrangement of this type at only one side of the support tray and to arrange one or more fixed projections on the other side.

It is likewise conceivable to provide suspension parts which have been threaded on, i.e. to displaceably arrange the holding elements by a guide. They can then remain or be locked in the desired position, for example by means of pivoting, e.g. by means of 90° folding down. The guide preferably extends parallel to the rail or such that the holding elements can be inserted into different means of holding the support trays.

It is also conceivable to design the holding elements as spring bolts or as spring balls which snap or latch into the means of holding a support tray at the desired positions and in this manner fix the holding elements, and thus also the support tray located thereon, at the desired position.

Provision is made in a further aspect of the invention for the holding elements to be made as rails which can be placed onto or plugged into the means of holding a support tray. The support trays can be placed onto these rails. Split storage plates or support trays can be used by the use of such rails.

In this process, a solution is particularly preferred in which the rails received in the container wall are made such that the aforesaid variants are possible without rail changes and without changes to the housing (foamed). Optionally, only changed holder elements are required. The advantage results from this that market requirements can be realized very fast.

The present invention makes it possible to obtain an inner container with refrigerating or freezing apparatus which is as smooth as possible without any troublesome edges. Provision is made in an advantageous aspect of the invention for the removal of the support trays, which can be made as glass plates, for example, to be removed with a 90° door opening. The support trays can be used without segment sections customary today.

Provided that the fastening means are arranged at rails, it is particularly preferred for them to be integrated in the side wall in a perpendicular and flush manner so that a smooth inner wall of the chilling space results. Undercuts of rails integrated in the container are preferably provided in a closed form for cleaning purposes.

It is particularly advantageous for as many vertical adjustment possibilities as possible to be provided for the support trays.

As stated above, the present invention opens up the possibility in a preferred aspect to be able to adjust the support trays comfortably without having to change anything at the housing or at the foamed portion and without the support trays having to be removed. It is, for example, conceivable to provide the support trays or glass plates with an adjustment mechanism to lock and unlock the glass plates, whereby the advantage results that the support trays can be adjusted vertically without them having to be removed from the refrigerating apparatus. It is, for example, also conceivable for the means of holding a support tray to be made as grooves which are provided, for example, in a rail and for the holding means to be made such that they are displaceable relative to the groove in a first position and are wedgeable in the groove in a second position.

The said rails can be manufactured in any desired shape and can be integrated into the container. Provision is preferably made for the rail to be small enough so that it does not weaken the insulation very much.

The material of the rails can largely be any desired one. For example, stainless steel, varnished sheet metal or plastic can be considered.

As stated above, the arrangement of the means of holding a support tray can largely be any desired one in the inner space. For example, three-point supports are conceivable, i.e. e.g. three rails of which one is arranged at the rear wall and two are arranged at the oppositely disposed side walls of the chilling space. It is likewise possible to provide two rails at a side wall of the chilling space and one rail at the oppositely disposed wall of the chilling space. Any desired design variants result with respect to the arrangement of the means of holding a support tray.

To be able to introduce the rails into the wall, provision is preferably made for preferably perpendicular grooves to be arranged at the side walls in the container. In the ideal case, the fastening is carried out by inserting the rails into the drawing die and the rails are then fixedly enclosed by means of undercuts and toothed arrangements on the drawing of the container. In this process, the toothed arrangements serve the purpose that the rails cannot fall down vertically on high load weights.

As stated above, it is of advantage for the upper edges of the rails to end in a flush manner with the container surface, i.e. the rails are introduced into the container side walls in a recessed manner.

As stated above, the rails can be made of plastic, stainless steel plate, sheet metal, varnished, as an injection extrusion part or as a profiled part. It is conceivable that the rails have a U-shaped cross-section in the widest sense (plus widened section/undercut for container fastening) and have symmetrical tapered sections at fixedly repeating intervals which form undercuts for suspension elements. The support trays are then laid, suspended or anchored at these suspension elements.

The tapered sections, cut-outs or support regions can be affixed at very narrow intervals, e.g. 10 mm, and thus provide an extremely high number of vertical adjustment possibilities. Different intervals are naturally also conceivable. Different intervals between the cut-outs/support regions are also possible.

BRIEF DESCRIPTION OF THE DRAWINGS

Further details and advantages of the invention result from the embodiment shown in the Drawing. There are shown:

FIGS. 1, 1A-1C, 2, 3A-3B, 4A-4B, 5A-5B, 6, 7A-7B, 8, 9A-9C, and 10A-10B: Figures of the rails received or to be received in the walls of the chilling space in various views and embodiments;

DESCRIPTION OF THE PREFERRED EMBODIMENTS

Figure 2:
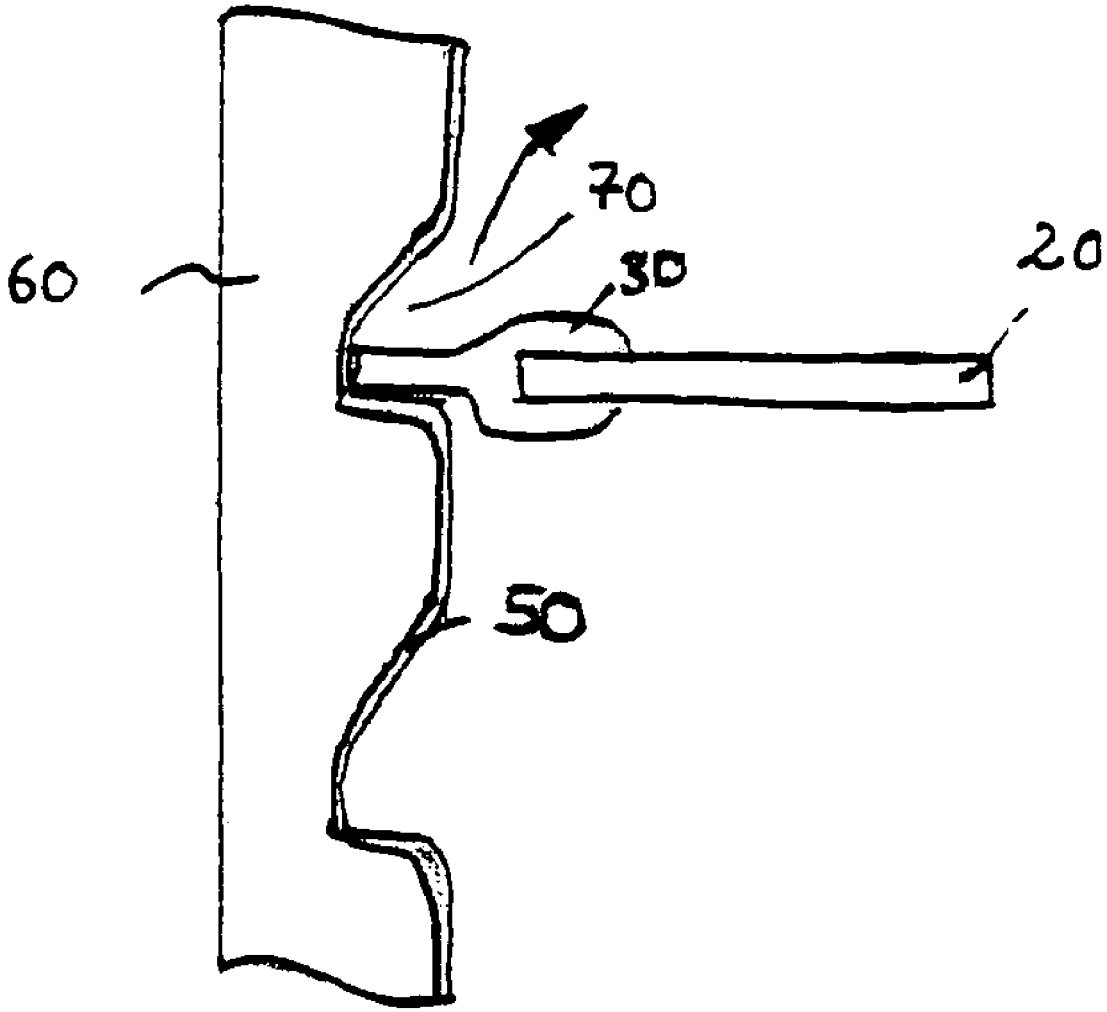

FIG. 1 shows the rail 10 which is introduced into a groove in a side wall or rear wall 50 of the chilling space of a refrigerating or freezing apparatus. The rail 10 has a substantially U-shaped profile in cross-section. Referring also now to FIGS. 1A to 1C, undercuts or widened portions are located at the limb ends and are connected to one another such that a closed profile results. Two or more holding elements 30 are located at the support tray 20 and can be inserted into the cut-outs 40 of the rail 10. The cut-outs 40 are formed by circular cuts in the side of the rail 10 facing the chilling space which have a fixed spacing from one another and are connected to one another by a gap. As can be seen from the sectional view in accordance with the top of FIG. 1, the side of the rail 10 facing the chilling space ends in a flush manner with the wall 50 of the chilling container. The reference numeral 60 designates the foamed section of the chilling container. The holding elements 30 can enclose the support trays at both sides or also only support them from below, as can likewise be seen from FIG. 1.

The holding elements 30 have a lug which is inserted into the cut-outs 40 of the rail 10 and furthermore has a contact surface for the reception of the glass plate 20.

FIG. 2 shows an embodiment in which the means of holding a support tray or the glass plate 20 consist of deep-drawn recesses 70 or support regions provided therein in the container wall 50. A rail is not necessarily provided here. By means of the holding elements 30, the glass plate 20 lies on the contact surfaces formed in the recesses 70. It can be removed by being pivoted out, as is indicated by the arrow in FIG. 2. It can also be seen from the embodiment in accordance with FIG. 2 that the means of holding a support tray, in this case the recesses 70 or the supports formed therein, do not project inwardly beyond the wall 50 of the container. A container inner wall without projecting support ribs also results in this case.

Figure 3A:
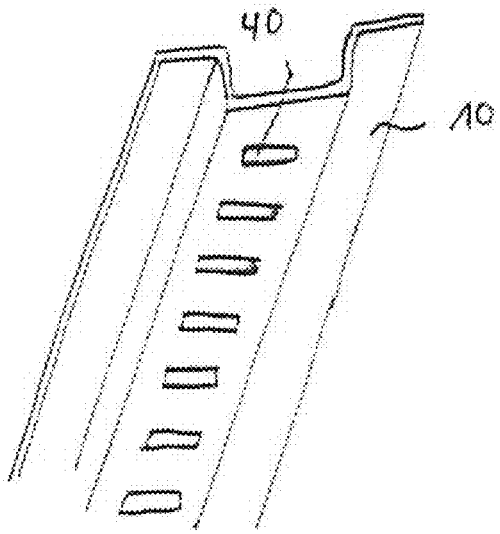
Figure 3B:
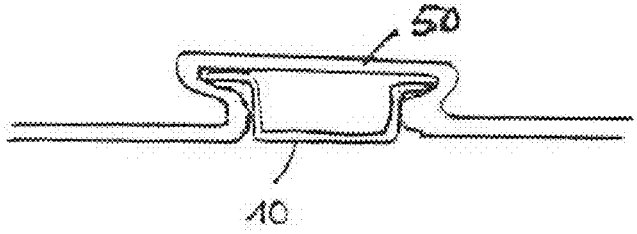

A further aspect of the rail 10 is shown in FIGS. 3A and 3B. In this case, the recesses 40 are made as stamped-out slots into which the holding elements can be inserted which hold the support trays. The rail 10 in accordance with FIG. 3 is also introduced into the container side wall 50 or into a groove located there such that it does not project. An advantage of the rail 10 in accordance with FIGS. 3A and 3B consists of it being able to be realized in a technically simple manner by profiling with an additional stamping unit.

FIG. 4A shows an embodiment of the rail 10 which likewise has a substantially closed U-shaped profile which is separated by a centrally extending gap on the side facing the chilling space. Stampings 80 are located approximately centrally at both sides next to the gap. FIG. 4B bottom shows the same profile with stampings 80' at the sheet metal edge directed toward the gap.

An open round profile 10 can be seen from FIG. 5B which has stamped holes 40 into which corresponding holding elements can be inserted on which the support trays are located. Ellipsoid or oval profiles are also possible instead of the round profiles shown. As also in the embodiment in accordance with FIG. 1, a gap is provided at the side of the profile facing toward the chilling space which extends in the longitudinal direction and connects the cut-outs 40 to one another. The sectional view in accordance with FIG. 5A shows that the profile is accepted in a flush manner in the wall 50 of the container of the apparatus.

Figure 6:
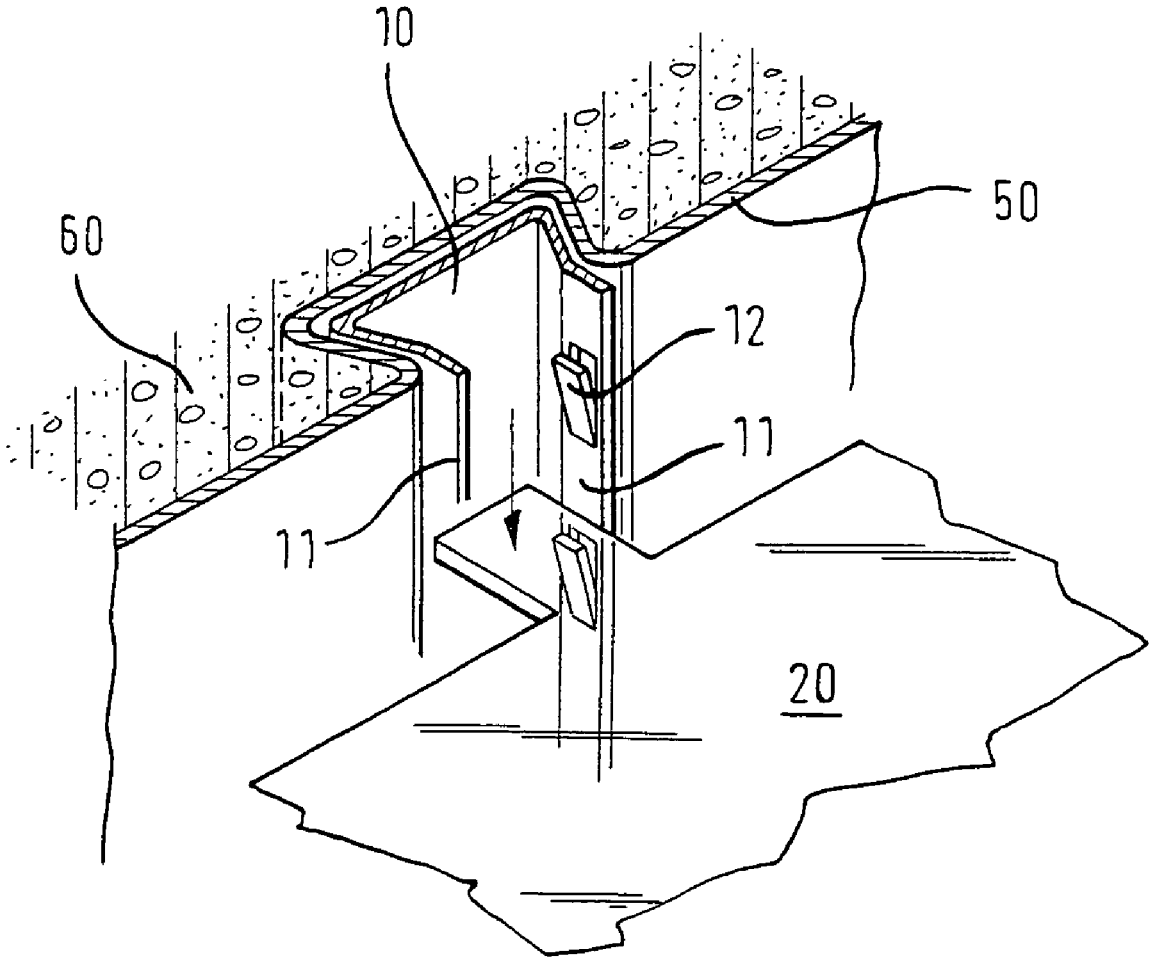

FIG. 6 shows a dovetailed profile. The rail 10 has sheet metal tabs 12 which serve as the glass plate support or as the support for the support trays 20. The tabs, which are e.g. made of sheet metal are "pushed out", as can be seen from FIG. 6. The tabs 12 are located at both sides of the limbs 11 of the rail facing one another. Starting from the chilling space, the limbs 11 merge into curved regions with a larger spacing, as can be seen from FIG. 6. The curved regions are connected at their side facing away from the limbs 11.

Figure 7A:
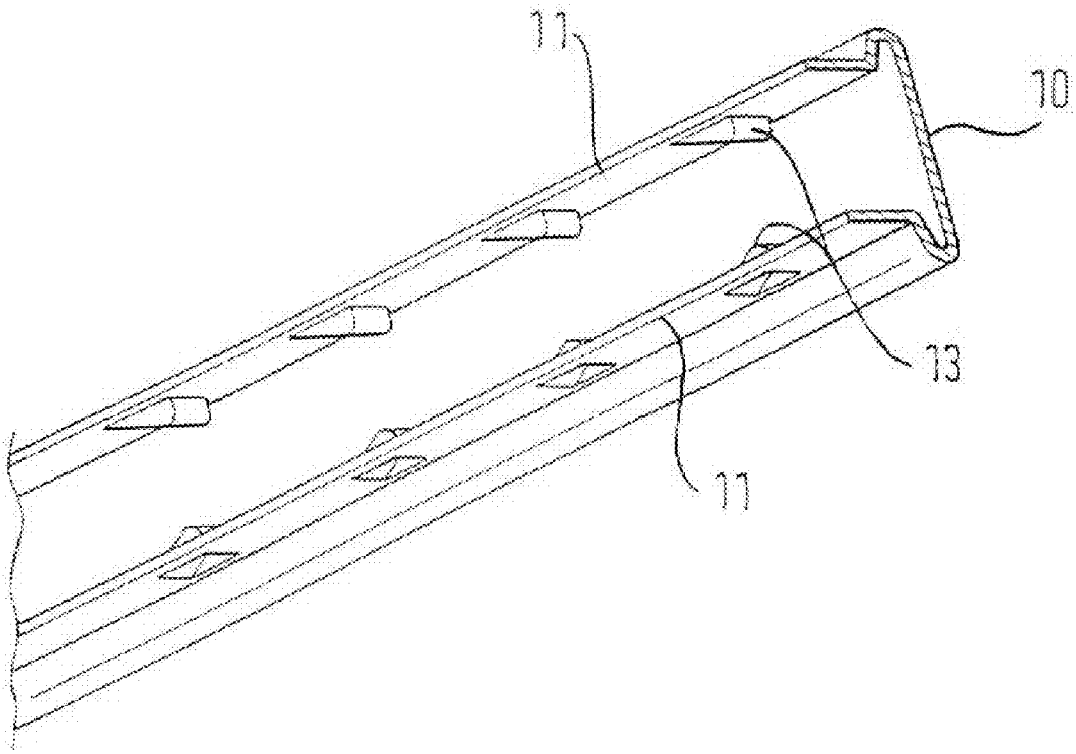

The said supports do not have to be made of sheet metal tabs. It is likewise possible to make the Supports as stampings ("dome"). An aspect of the invention of this type can be seen from FIG. 7A. The rail 10 in accordance with FIG. 7 has two parallel limbs 11 which bound a space accessible from the chilling space. Projections 13, which are made as stampings and serve as support surfaces for support trays or for holding elements supporting the support trays, are located at the sides of the limbs 11 facing one another.

Figure 7B:
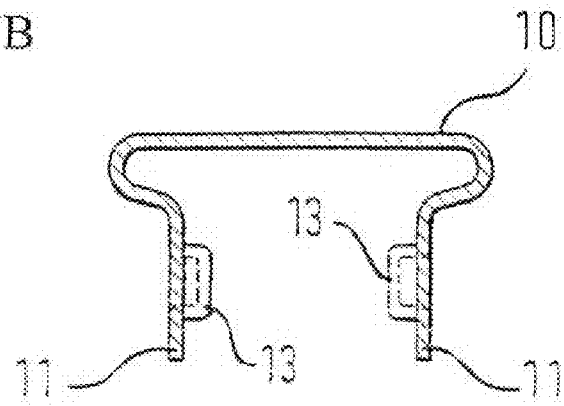

Starting from the chilling space, the limbs 11 initially extend in parallel and then merge into curved regions with a larger spacing. The curved regions with an essentially U shape in cross-section are connected at their side facing away from the limbs 11, as is shown in FIG. 7B.

Figure 8:
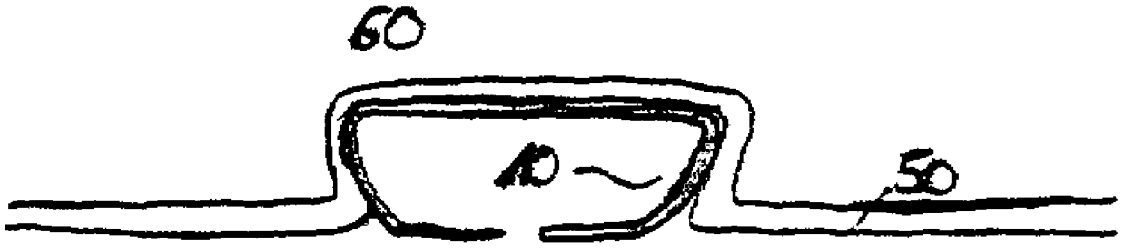

FIG. 8 shows a further profile with different principles of the latching, said profile likewise ending flush with the inner container at its side facing the cooling space. Reference numeral 50 designates the container wall. Reference symbol 60 designates the foamed portion.

Figure 9A:
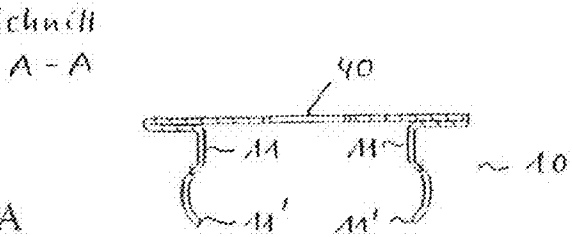
Figure 9B:
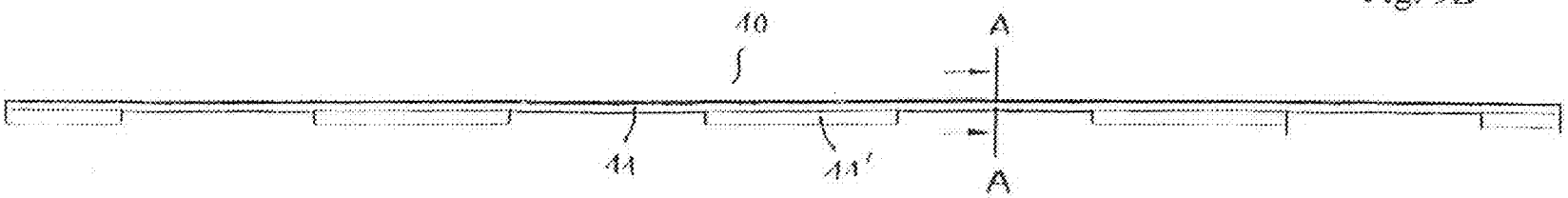
Figure 9C:
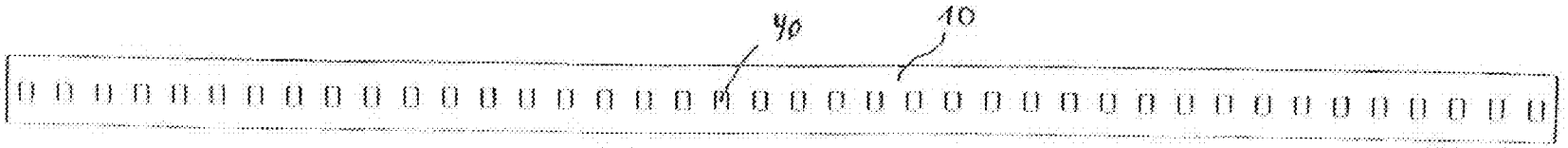

FIG. 9A shows a further possible embodiment of the rail 10 in a sectional view (top), FIG. 9B in a side view (middle representation) and FIG. 9C in a plan view (bottom). In its side facing toward the chilling space, the rail is planar and has a plurality of cut-outs 40 spaced apart in the longitudinal direction of the rail 10. This side of the rail 10 terminates with the wall of the container so that a smooth inner container results. On the side remote from the chilling space, the rail 10 has two parallel limbs 11 which merge sectionally into curved sections 11', as can be seen from FIG. 9. The curved sections 11' can be spaced apart from one another in accordance with embodiment of FIG. 9B or can also be made continuously. The limbs 11 and the curved sections 11' serve the fixing of the rail 10 in the container of the refrigerating or freezing apparatus.

Figures 10A, 10B:
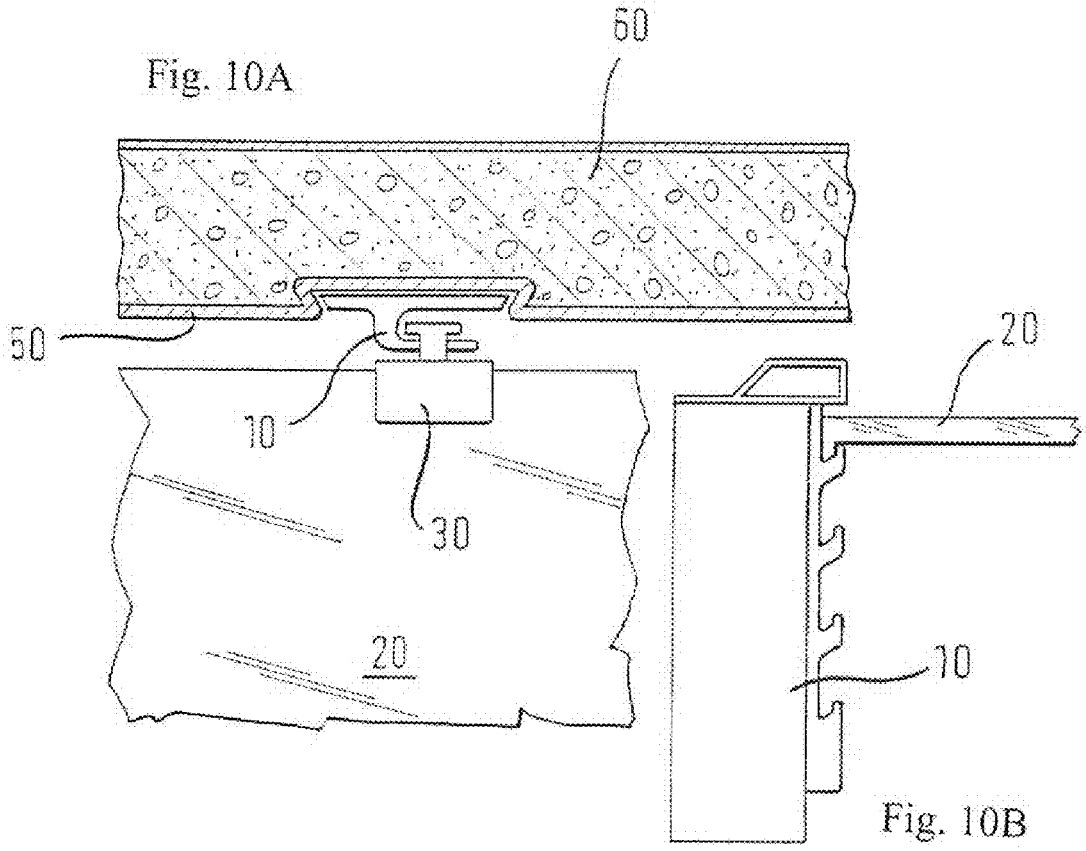

Finally, a rail 10 can be seen from FIGS. 10A and 10B which has hook-shaped reception regions on which the glass plate 20 or corresponding holders can be placed.

The rails described above can be in communication with a yielding or resilient material 110, as shown in FIG. 1A, such that the material 110 closes the cut-outs of the rails not required for the holding of support trays. The resilient or yielding material 110 is arranged in the side of the rail remote from the chilling space. Provision can be made in this process for the yield material 110 to close the cut-outs such that a smooth front side of the rails toward the chilling space also results in the region of the cut-outs.

Figure 11:
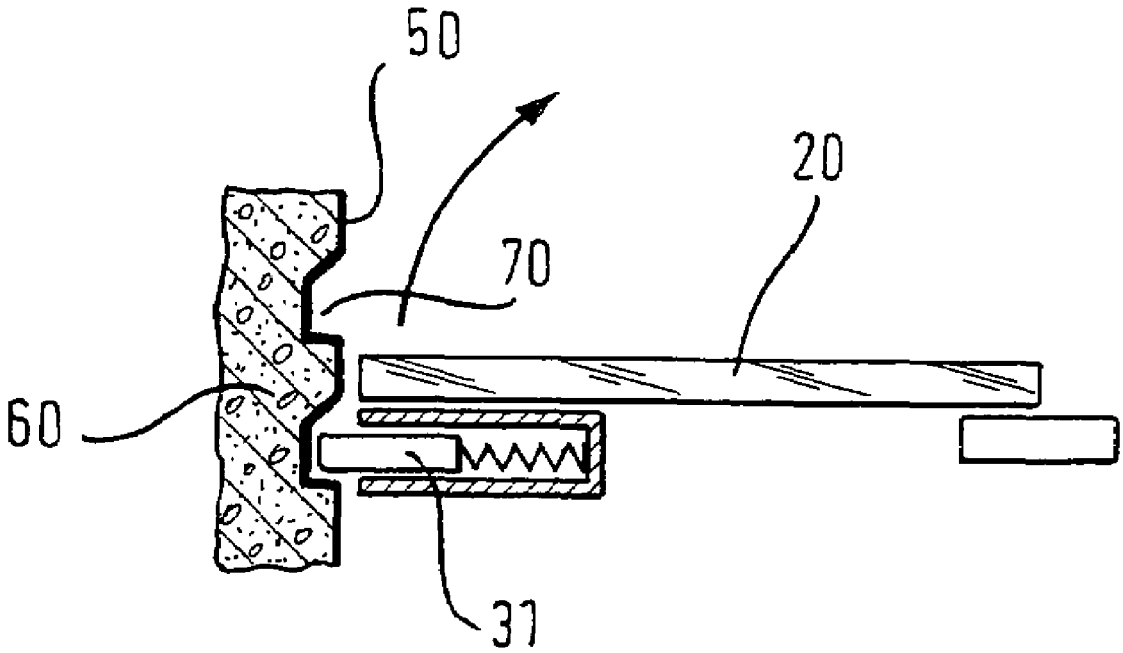
FIG. 11: a sectional view of a support tray with a holding element having a spring bolt.

FIG. 11 shows an embodiment comprising a holding element which is arranged beneath a glass plate 20 and has a spring bolt 31. In the position shown, the spring bolt 31 engages into a recess 70 in the wall 50 of the container and lies on an areal region arranged there. The bolt 31 holds the plate 20 in the desired position in this manner. If the bolt 31 is inserted, the plate can be displaced vertically until the desired position has been reached. An embodiment with a spring ball is also conceivable. The removal can take place by pivoting in the direction of the arrow, with the upper boundary of the recess being chamfered for this purpose.

Figure 12:
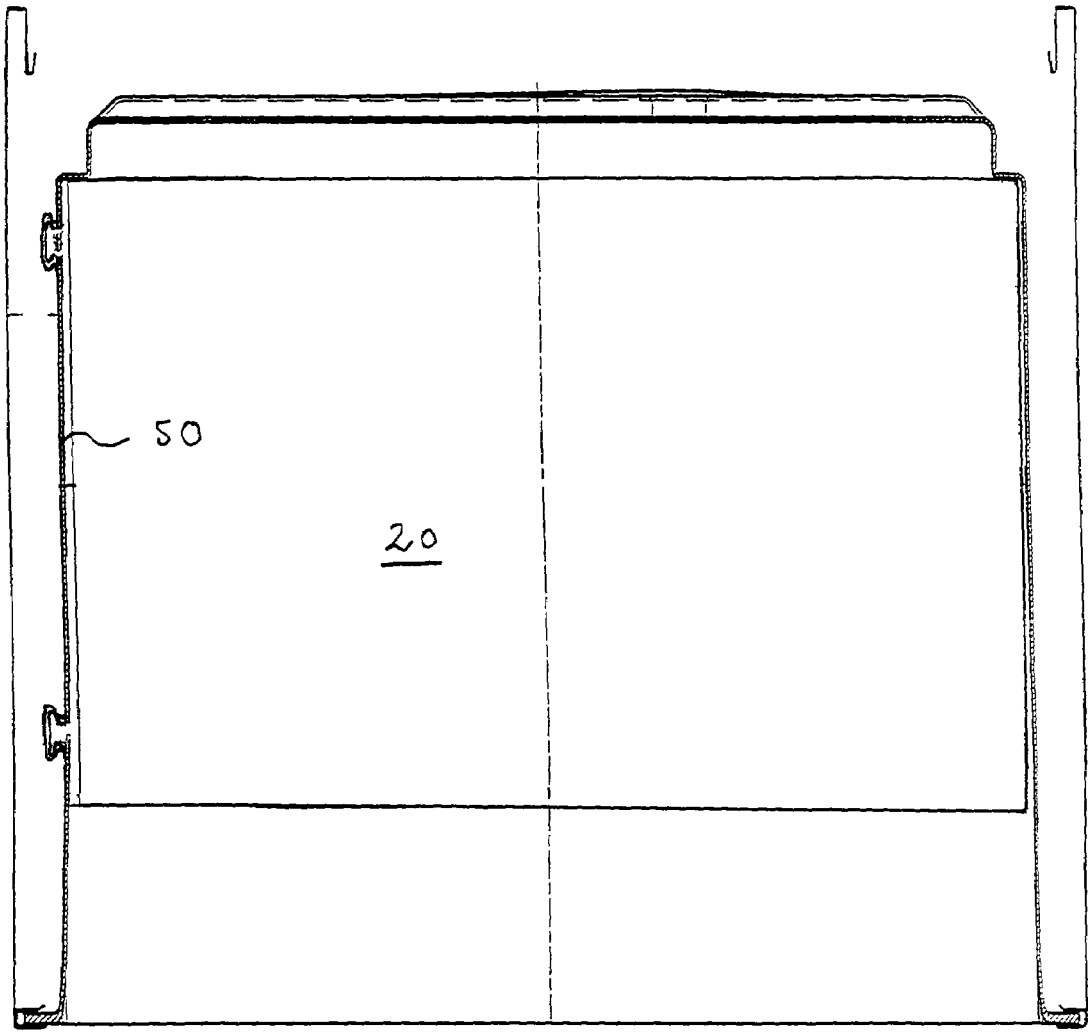
FIG. 12: a sectional view through the refrigerating apparatus in accordance with the invention with a glass plate.

FIG. 12 shows the inner container of the inventive refrigerating apparatus in cross-section whose walls 50 bound the chilling space. Two indentations are shown here which are spaced apart from one another, are of groove shape, extend perpendicularly and serve the reception of the rail described above. Reference numeral 20 characterizes the glass plate which is held at the rails by means of holding elements.

Figure 13B:
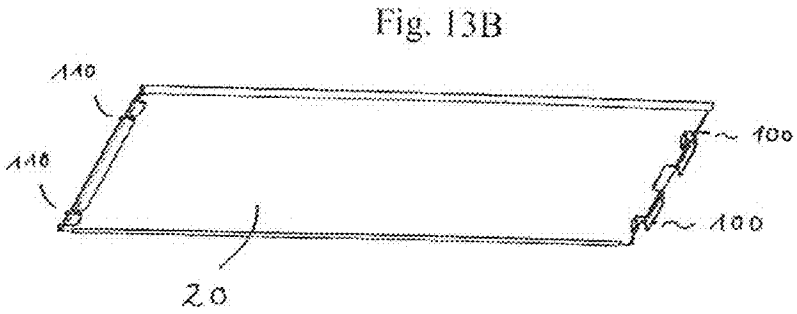
FIGS. 13A-13D: various views of a support tray with a detail view of the holding elements.
Figure 13D:
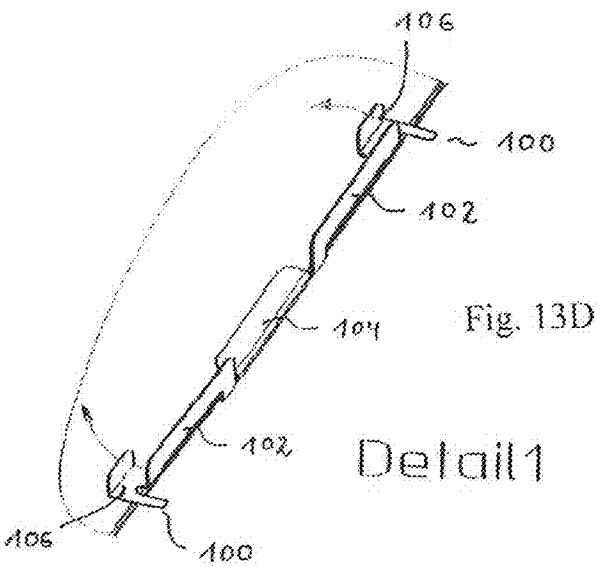
Figure 13A:
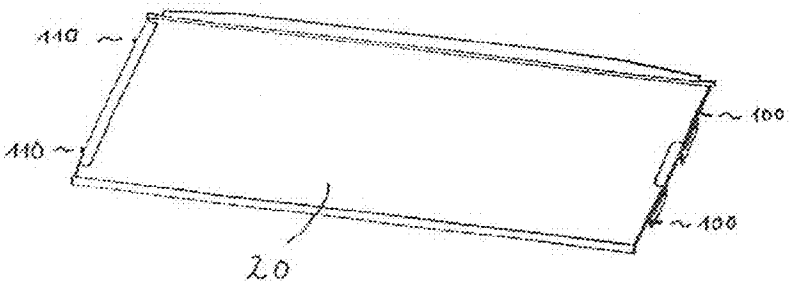
Figure 13C:
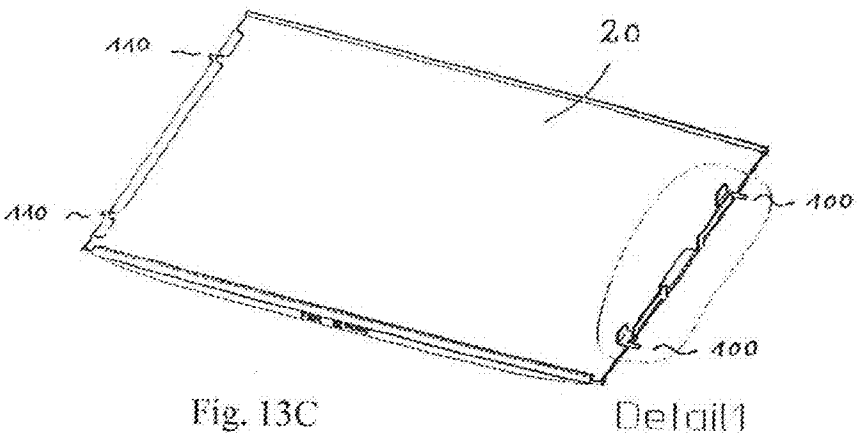

FIGS. 13A to 13D show a support tray 20 in different views with holding element 100, 110 arranged thereon. FIG. 13A, upper illustration, shows the support tray 20 in a perspective view from the front and from the top (left hand illustration) or, as seen in FIG. 13B, from the bottom (right hand illustration). A view of the support tray is shown in FIG. 13C, left hand illustration, in a view from behind and from below with detail 1. FIG. 13D, right hand illustration, shows the detail in an enlarged view. It can be recognized from the said views that the support tray 20 has holding elements 100 on one of its narrow sides which consists of projections which are in communication with spring metal sheets 102. The spring metal sheets 102 are secured jointly to a section 104 which is in fixed communication with the support tray 20. In their respectively other end regions directed toward the projections 100, the spring metal sheets 102 merge into an angular section 106 to which the projection 100 is secured. This angular section 106 serves as an actuation element to bend the spring metal sheets 102 in the direction of the arrow in accordance with the detail view so that the projections 100 are moved in the direction toward the support tray 20 and away from the container wall and are removed from the means of holding a support tray in this process. In the non-actuated state in accordance with the detail view in FIG. 13D the projections 100 project beyond the edge region of the support tray 20 and engage, in the assembled state of the support tray 20, into cut-outs or lie on support surfaces which are located at the container inner wall.

As can further be seen from FIG. 13D, holding elements 110 are also located at the oppositely disposed narrow side of the support tray 20. They consist, however, of fixed projections which are fastened to the support tray 20 or to its glass plate by means of a metal strip.

The invention claimed is:

1. A refrigerating or freezing apparatus comprising a chilling space for the reception of the refrigerated or frozen product, the chilling space being defined by a front opening and a wall having a side portion and a rear portion, and stationary means for holding a support tray wall, the wall defining a recess being spaced apart from the opening and the stationary means comprising a rail structured and arranged to be mounted in the recess and in flush alignment with an interior surface of the wall, the rail including a plurality of openings configured for holding the support tray wherein the rail includes a yielding material disposed along the openings, said yielding material being fastened adjacent a side of the rail remote from the chilling space such that it closes the openings so that a smooth surface results in regions of the openings and resiliently yields accordingly in response to the insertion or introduction of holding elements of the support trays into the openings.

2. A refrigerating or freezing apparatus in accordance with claim 1, wherein the openings are cut-outs.

3. A refrigerating or freezing apparatus in accordance with claim 1, wherein the openings are cut-outs spaced apart from one another in the vertical direction of the chilling space.

4. A refrigerating or freezing apparatus in accordance with claim 1, wherein the openings are support surfaces.

5. A refrigerating or freezing apparatus in accordance with claim 4, wherein the support surfaces are made as tabs or as areal regions.

6. A refrigerating or freezing apparatus in accordance with claim 4, wherein the support surface is a groove or gap.

7. A refrigerating or freezing apparatus in accordance with claim 4, wherein the support surfaces are made as planar regions.

8. A refrigerating or freezing apparatus in accordance with claim 1, wherein the openings of the rail are support surfaces spaced apart from one another.

9. A refrigerating or freezing apparatus in accordance with claim 1, wherein the rail is U-shaped, box-shaped, circular, oval or dovetailed in cross-section or has sections profiled in this manner.

10. A refrigerating or freezing apparatus in accordance with claim 9, wherein the rail has two limbs which bound a space accessible from the chilling space and, at whose sides facing one another, the openings are support surfaces.

11. A refrigerating or freezing apparatus in accordance with claim 10, wherein the limbs extend in parallel or converge toward or diverge away from one another in the direction of the chilling space.

12. A refrigerating or freezing apparatus in accordance with claim 10, wherein support surfaces are arranged and formed by tabs projecting from the limbs or by stampings located in the limbs.

13. A refrigerating or freezing apparatus in accordance with claim 1, wherein the rail has an undercut.

14. A refrigerating or freezing apparatus in accordance with claim 1, wherein the rail is made in one piece or is composed of a plurality of segments spaced apart in the vertical direction of the chilling space.

15. A refrigerating or freezing apparatus in accordance with claim 1, wherein the rail is received in the wall of the chilling space in a vertically or slantingly extending manner.

16. A refrigerating or freezing apparatus in accordance with claim 1, wherein a plurality of recesses are provided in the wall of the chilling space for reception of a corresponding plurality of rails.

17. A refrigerating or freezing apparatus in accordance with claim 1, wherein the openings are cut-outs and wherein cut-outs not required for the holding of support trays are closed.

18. A refrigerating or freezing apparatus in accordance with claim 1, wherein the openings are cut-outs and the yielding material is an elastomeric strip being disposed along the cut-outs.

19. A refrigerating or freezing apparatus in accordance with claim 1, wherein holding elements are provided which cooperate, in the assembled state of a support tray, with the support tray and with the means of holding a support tray located in the wall of the chilling space.

20. A refrigerating or freezing apparatus in accordance with claim 19, wherein the holding elements are made as support elements which have a first section which is inserted into or placed on the means of holding a support tray and have a second section on which the support tray lies.

21. A refrigerating or freezing apparatus in accordance with claim 19, wherein the holding elements have an adjustment mechanism by means of which the holding elements are adjustable between a first position in which the holding elements are in engagement with the means for holding a support tray and a second position in which the holding elements are not in engagement with the means for holding a support tray.

22. A refrigerating or freezing apparatus in accordance with claim 19, wherein the holding element or holding elements are arranged at the support tray.

23. A refrigerating or freezing apparatus in accordance with claim 19, wherein the holding elements have projections which are resiliently arranged such that they are in engagement with the means for holding a support tray in a first position and are not in engagement with the mean for holding a support tray in a second position.

24. A refrigerating or freezing apparatus in accordance with claim 19, wherein the holding elements are arranged displaceably by means of a guide relative to the means for holding a support tray.

25. A refrigerating or freezing apparatus in accordance with claim 19, wherein the holding elements are made as spring bolts or spring balls or comprise these.

26. A refrigerating or freezing apparatus comprising a chilling space for the reception of the refrigerated or frozen product, the chilling space being defined by a front opening and a wall having a side portion and a rear portion, and stationary means for holding a support tray wall, the wall defining a recess being spaced apart from the opening and the stationary means comprising a rail structured and arranged to be mounted in the recess and in flush alignment with an interior surface of the wall, the rail including a front side facing the chilling space and an opposite side remote from the chilling space, the rail including a plurality of openings configured for holding the support trays wherein the rail includes a yielding material disposed on the opposite side remote from the chilling space and extending to and ending at the front side of the rail such that the yielding material resiliently closes the openings so that a smooth surface results in regions of the openings, wherein the openings are circular or oval cutouts.

* * * * *